United States Patent [19]

Gorrafa

[11] 3,971,108

[45] July 27, 1976

[54] SET APPARATUS FOR TREATING YARN AND PROCESS FOR STRINGUP THEREOF

[75] Inventor: Adly Abdel-Moniem Gorrafa, Hockessin, Del.

[73] Assignee: E. I. Du Pont De Nemours & Company, Wilmington, Del.

[22] Filed: Mar. 31, 1975

[21] Appl. No.: 563,403

[52] U.S. Cl. ..... 28/1.4; 28/72.12

[51] Int. Cl.[2] ..... D02G 1/16

[58] Field of Search ..... 28/1.4, 72.12; 57/34 B, 57/157 F, 140 B

[56] References Cited

UNITED STATES PATENTS

| | | | |
|---|---|---|---|
| 2,938,257 | 5/1960 | Bauer | 28/1.4 |
| 2,995,801 | 8/1961 | Cormier et al. | 28/1.4 |
| 3,253,396 | 5/1966 | Fish | 28/1.4 |
| 3,381,346 | 5/1968 | Benson | 28/1.4 |

*Primary Examiner*—Louis K. Rimrodt

[57] ABSTRACT

A jet apparatus has a body member having a yarn passage with a semi-circular cross section cut in one face, a single air orifice of diameter less than the yarn passage entering the yarn passage from the body side at an angle of 80° to 90° to the yarn passage, a cover plate secured by two screws and pivotable about one for stringup, and guides holding two yarns separated as they contact the yarn passage entrance. The jet apparatus is strung up passing two ends of false-twist-textured yarn separately into the yarn passage of the jet with the cover plate swung open while holding both running ends in a waste jet at a relatively high tension to keep the yarns separated in the yarn passage and finally closing and securing the jet cover. Turning on pressurized air to the jet and transferring both yarns simultaneously from the waste jet to a windup where they are wound at lower tension allow the two ends to combine together in the jet.

9 Claims, 5 Drawing Figures

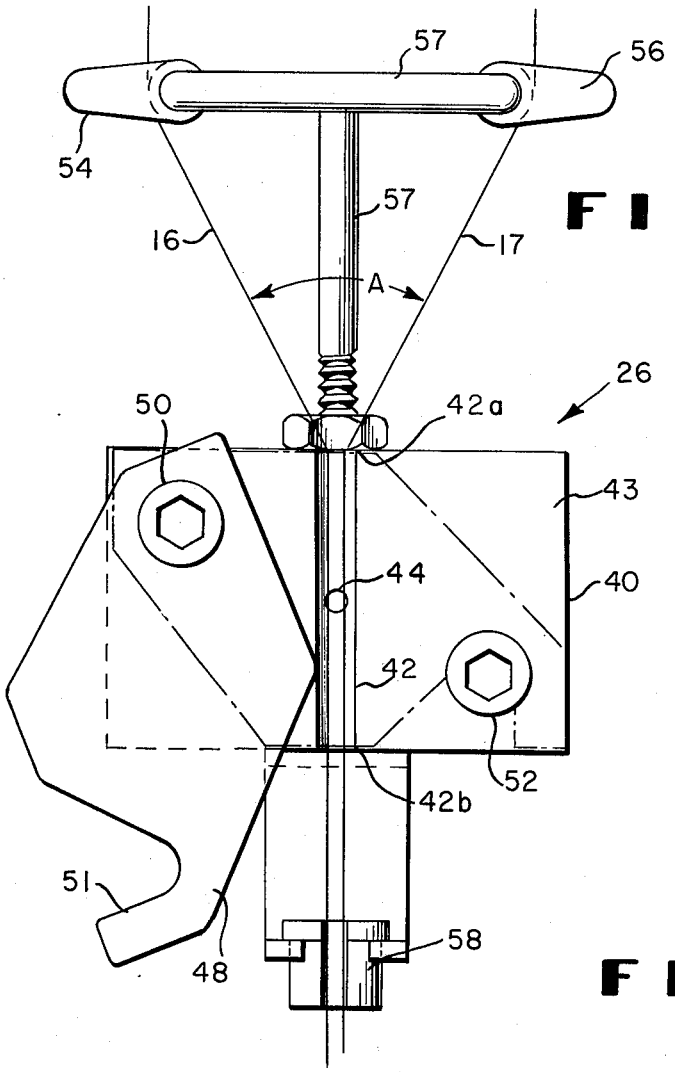
FIG. 2
FIG. 4
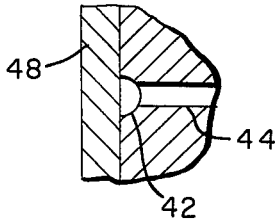
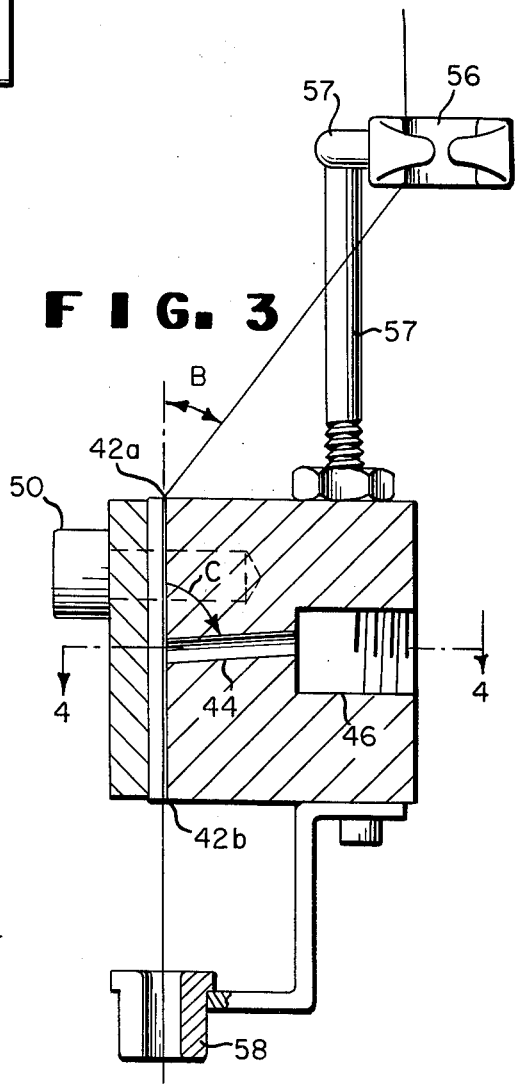
FIG. 3
FIG. 5
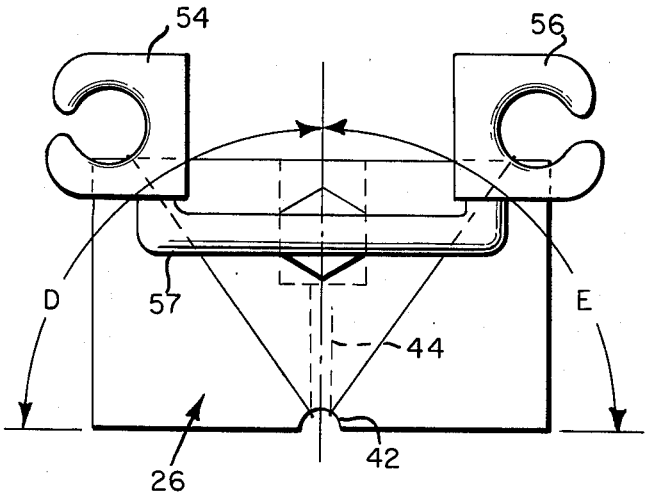

SET APPARATUS FOR TREATING YARN AND PROCESS FOR STRINGUP THEREOF

BACKGROUND OF THE INVENTION

This invention relates to yarn production and handling and more particularly is related to a jet apparatus for combining two false-twist-textured yarns on a false-twist-texturing machine into a common strand of yarn prior to packaging.

False-twist-textured yarn producers are often required to produce plied yarns to fulfill specific needs in the textile trade. To insure adequate handling characteristics, it has been customary to twist such yarns together. However, conventional true twisting is expensive and time consuming and being a discontinuous operation, adds disproportionately to the cost of the yarn. Recently it has been proposed to combine such yarns as part of continuous false-twist-texturing process by passing them through an air jet prior to winding on a false-twist-texturing machine thereby combining the two yarn bundles into a single cohesive strand. With presently available orifice jet devices, it has been found that to satisfactorily start up a false-twist-texturing machine, both yarns must be threaded through the jet orifice simultaneously and this involves the very intricate task of starting two positions on the machine simultaneously. If done otherwise, i.e., by stringing each end separately through a jet having an open string up slot, the slow or nonrunning yarn will engage the running yarn and retard it sufficiently to force it to bunch up on processing rolls and break.

It is therefore an object of this invention to provide a jet apparatus, for use with a false-twist-texturing machine to combine two ends of a false-twist-textured yarn into a single end of yarn, that enables each one of the two ends to be strung up separately through the jet without interfering with the other.

SUMMARY OF THE INVENTION

In its preferred embodiment, the jet apparatus of this invention comprises a body member having a yarn passage of semi-circular cross section cut in one face covered by a removable cover and a conduit smaller in diameter than the yarn passage within the body member for introducing fluid into the yarn passage. Attached to the entrance end of the jet body is a guide arrangement for providing two separate yarn paths converging toward the entrance to the jet. Proper tensioning of each yarn bundle maintains the yarn bundles separated in the yarn passage until the cover is closed and the tension is lowered on the yarn bundles such that they combine in the yarn passage when air is supplied to the jet. The guide arrangement includes two guides, one located in each of the quadrants of the semi-circle of the yarn passage cross section extended away from the entrance of the yarn passage, and at such a distance from the axis of the passage as to establish two yarn paths approaching the entrance of the yarn groove at an angle of from about 15° to about 60° to the axis with the included angle between the yarn paths being about 60° to about 90°.

To string up the jet apparatus, an operator will divert the yarns around the jet and its associated guide arrangement to waste at a tension somewhat higher than the winding tension for the yarns. He then opens one side of the yarn passage in the jet and individually lays the yarns into the guide arrangement and into the passage without impinging air on them. The yarns are maintained separate in the passage by converging them toward the entrance to the passage at an angle with the axis of the passage and with an included angle between the yarns as defined above. The operator then closes the open side of the passage, turns the air on to impinge the yarns in the passage and then transfers the yarns from the waste to a windup station.

Preferably, commingling or combining of the yarns is carried out as an adjunct to false-twist-texturing taking advantage of existing suitable yarn forwarding means and preferably the yarn produced is a combination of two ends textured with opposite twist (i.e., one end with S-twist and one end with Z-twist). The commingled product contains false-twist-texturing helical crimp in the filaments and is coherently held together with randomly spaced regions of high entanglement (higher than the yarn average). There are occasional but infrequent sections of low entanglement where the constituent single ends may be identified.

BRIEF DESCRIPTION OF THE DRAWINGS

FIG. 2 is a front elevation of a preferred jet apparatus of this invention with the cover open showing the yarns in stringup position.

FIG. 3 is a side view of FIG. 1 sectioned through the yarn passage.

FIG. 4 is a fragmentary section of FIG. 3 taken along 4—4.

FIG. 5 is a top view of FIG. 2 with the cover removed.

DETAILED DESCRIPTION OF THE PREFERRED EMBODIMENT

Figure 1:
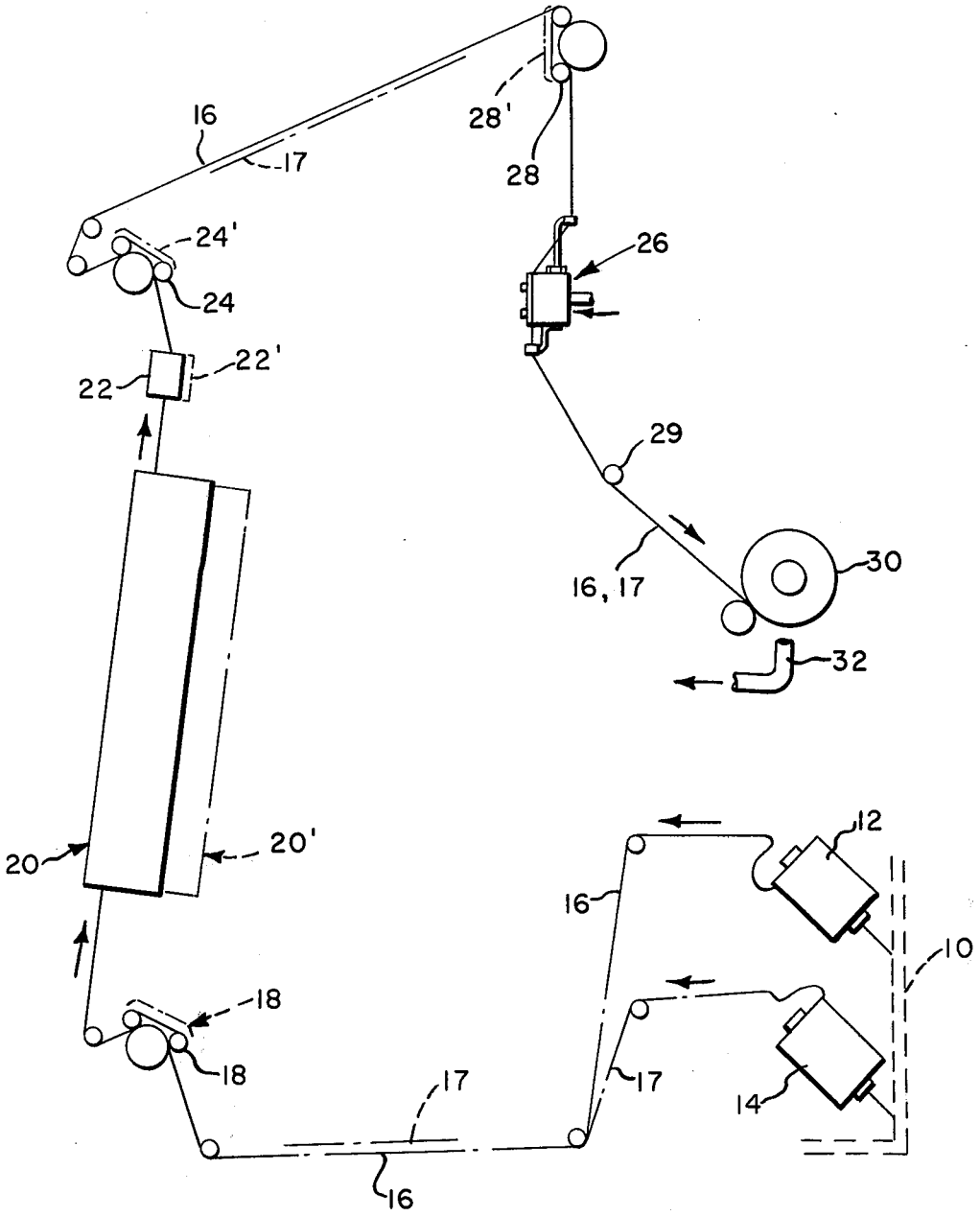
FIG. 1 is a schematic illustration of a false-twist-texturing machine with the jet apparatus of this invention in place in the yarn path of the machine.

Referring to FIG. 1, the machine chosen for purposes of illustration is a multiposition false-twist-texturing machine for producing stretch yarns and includes a frame 10 supporting supply packages 12, 14. The yarn 16 from the supply package 12 passes in the usual well known manner to feed rolls 18, through heater 20, through false-twist spindle 22 to intermediate rolls 24. In stretch yarn texturing, the yarn is then guided over take-up rolls 28 and through jet 26 for windup on package 30. A waste collector 32 is provided adjacent the windups. A neighboring texturing position operates in the same fashion; yarn 17 from supply package 14 is passed through identical elements designated by prime numerals except that from take-up rolls 28' the yarn 17 is wound on package 30 rather than on a separate package.

The preferred structure for air jet 26 is more fully shown in FIGS. 2–5 wherein the body member 40 contains a fluid conduit 44 communicating at one end with a fluid chamber 46 and at the other end with yarn passage 42. Chamber 46 may be supplied with fluid, preferably air from any convenient source, not shown.

Yarn passage 42 is a semi-circular channel having an entrance **42*a* and an exit 42*b* formed in the planar surface 43 of the body 40. Conduit 44 intersects yarn passage 42 at a location midway along its length. The conduit axis intersects the passage axis centrally with no eccentricity to avoid unidirectional torque jet effects. Air impingement on the yarns 16, 17** in the passage is substantially perpendicular (i.e., at an angle C of 80° to 90° with the yarn path) with air pressure in the range of from 5 to 50 psig. being supplied to conduit 44. Conduit 44 is of a diameter less than the width of the yarn passage 42 and preferably about one-half the width of the yarn passage.

The yarn paths into the jet are controlled by guides 54, 56 positioned above and behind the yarn entrance to the jet on stand 57 attached to the top of the jet body 40. The yarns exit the jet as a unitary strand and pass through guide 58 positioned below and aligned with the jet exit. The guides 54, 56 are positioned so that yarns 16, 17 converge toward the entrance to the jet at an included angle A of from about 60° to about 90° (FIG. 2) and are angled with respect to the yarn passage axis at an acute angle B of from about 15° to about 60° (FIG. 3).

Another way to describe the location of guides 54, 56 is shown in FIG. 5, wherein guide 54 is located in the quadrant D of the semi-circle of the yarn passage cross section, the quadrant being extended ahead of the yarn entrance and similarly guide 56 is located in quadrant E of the semi-circle of the yarn passage. Both guides are located at such a distance from the axis of the yarn groove to establish two yarn paths approaching the yarn passage entrance at the above-defined angles A and B.

A cover 48 is held to body 40 by two screws 50, 52 and when in a closed position (indicated by the dashed lines) its inner planar surface engages the planar surface 43 of the body 40 to provide an enclosed yarn passage through the jet (FIG. 4) with an entrance at the top and an exit on the bottom of the jet body. Screw 50 retains the cover 48 with the body 40 and when loosened, serves as a center of rotation for the cover which in FIG. 2 is shown in a freely hanging position exposing passage 42. Screw 52 also stays with the jet body 40 and grips the slot 51 when the cover is swung over to cover the yarn passage. This assembly is easily operated with one hand which is important to a complex stringup such as that involved with false-twist-texturing machinery.

The advantage of this slot-type jet with its special guide arrangement is best appreciated in that the operator can start yarn 16 running through its sequence to waste collector 32, then start yarn 17 actually running through its sequence to same waste collector. The running yarn 16 is then guided through guide 54, laid in passage 42 and guided through guide 58, then the other running yarn 17 is similarly guided through guide 56, laid in passage 42 and guided through guide 58. The unique geometry of the jet and guides prevents any substantial contacting of the filaments of yarn 16 with the filaments of yarns 17, while they are laid in the yarn passage 42, to the extent that no retardation is imposed by one yarn on the other during the act of stringup. Therefore, not only is the stringup successfully accomplished without a break, but the need for expensive skilled labor to perform simultaneous startups is also eliminated. After both yarn ends are in the passage 42, the filaments are found to be fully contained within the passage cavity such that upon securing cover 48 tightly over the passage no filaments are pinched there between. Air is then turned on and commingled yarn is produced.

Although the jet and guides are shown as a single unit, it may be desirable to mount these parts separately on the machines.

Furthermore, while a semi-circular cross section for yarn passage 42 is preferred, other arcuate cross sections for the passage would be suitable such as elliptical or parabolic. Even a rectangular cross section could be considered for at least the entrance portion of the passage. Planar surface 43 of the jet body could also be formed as a curved surface provided the cover 48 has an inner surface which is compatible for closing the open side of passage 42.

The string up of the jet and associated guides of this invention was compared with a similar jet with a conventional single pig tail guide located ahead of the jet entrance along the axis of the yarn passage. Numerous string up trials were successful using the apparatus of this invention, while by contrast the string ups with the conventional single guide were less than satisfactory.

What is claimed is:

1. A jet apparatus for treating yarn comprising:
a body member having a surface with a yarn passage in said surface extending from an entrance to an exit, said yarn passage having a semi-circular cross section;
a conduit within said body member intercepting said passage for introducing fluid into said passage;
a removable cover enclosing said passage;
and guide means located in each quadrant of the semi-circle of said passage cross section and positioned with relation to said entrance for providing two separate yarn paths converging toward said entrance, said yarn paths converging at an included angle of from about 60° to about 90° and being at an acute angle with the axis of said yarn passage of from about 15° to about 60°.

2. The jet apparatus of claim 1, including a guide positioned beyond and aligned with said exit.

3. The jet apparatus of claim 1, said surface being planar.

4. The apparatus of claim 1, said cover being pivotally mounted to said body member for swinging movement from a position enclosing said passage to a freely hanging position exposing said passage.

5. The apparatus of claim 1, said conduit having an axis which forms an angle of from about 80° to about 90° with said surface.

6. A jet apparatus for treating yarn comprising:
a body member having a planar surface with a yarn passage in said surface extending from an entrance to a exit, said yarn passage having a semi-circular cross section;
a conduit within said body member intercepting said passage for introducing fluid into said passage, said conduit having an axis which forms an angle substantially perpendicular to said planar surface;
a removable cover enclosing said passage;
and guide means located in each quadrant of the semi-circle of said passage cross section and positioned with relation to said entrance for providing two separate yarn paths converging toward said entrance, said yarn paths converging at an included angle of from about 60° to about 90° and being at an acute angle with the axis of said yarn passage of from about 15° to about 60°.

7. The apparatus of claim 6, said cover being pivotally mounted to said body member for swinging movement from a position enclosing said passage to a freely hanging position exposing said passage.

8. In a process for combining at least two ends of textured yarns including the steps of feeding the yarns to the entrance of a jet device, passing the yarns through a yarn passage in the jet, and impinging air on the yarns in the passage of the jet to combine them prior to winding, the improvement in stringing up said process comprising: feeding said yarns past said jet device at a tension higher than the winding tension for the yarns; opening one side of the passage; individually laying the yarns into the passage without impinging air on the yarns; maintaining the yarns separate in the yarn passage by converging them toward the entrance to the passage at an included angle and at an angle with the axis of the yarn passage; covering the open side of the passage; impinging air on said yarns in said passage; and winding the yarns.

9. The process as defined in claim 8, wherein the yarns are maintained separate by converging them toward said entrance at an included angle of from about 60° to about 90° and at an angle with the axis of the yarn passage of from about 15° to about 60°.

* * * * *